United States Patent [19]

Kenney et al.

[11] Patent Number: 4,626,278

[45] Date of Patent: Dec. 2, 1986

[54] TANDEM ATOMIZATION METHOD FOR ULTRA-FINE METAL POWDER

[76] Inventors: George B. Kenney, 131 Green St., Medfield, Mass. 02052; Charles P. Ashdown, 85 Wachusett Ave., Arlington, Mass. 02174

[21] Appl. No.: 634,785

[22] Filed: Jul. 26, 1984

[51] Int. Cl.[4] ..... B22D 23/08

[52] U.S. Cl. ..... 75/0.5 C; 266/202; 75/0.5 BA; 75/0.5 BB; 264/11

[58] Field of Search ..... 75/0.5 C, 0.5 BA; 266/202

[56] References Cited

U.S. PATENT DOCUMENTS

| | | | |
|---|---|---|---|
| 2,371,105 | 3/1945 | Lepsoe | 75/0.5 C |
| 3,510,546 | 5/1970 | Wentzell | 264/13 |
| 3,840,623 | 10/1974 | Olsson | 264/12 |
| 4,192,673 | 3/1980 | Baba et al. | 75/0.5 C |
| 4,233,062 | 11/1980 | Siddall | 75/0.5 C |

OTHER PUBLICATIONS

Metals Handbook, 9th ed., vol. 7, Powder Metallurgy, American Society of Metals, Metals Park, Ohio 44073.

S. J. Savage and F. H. Froes, Journal of Metals, Apr. 1984, p. 20.

N. J. Grant, Journal of Metals, Jan. 1983, p. 20.

*Primary Examiner*—Veronica O'Keefe

*Attorney, Agent, or Firm*—Bromberg, Sunstein & McGregor

[57] ABSTRACT

Soluble gas is introduced in a melt material which is then atomized and rapidly cooled. The cooling drives the gas from solution, further disintegrating the atomized material to an ultra-fine powder. In one embodiment the atomization and rapid cooling are effected using a gas atomization die. Introduction of the soluble gas may be effected by addition of reactive constituents to the melt, for reactively forming such gas. Finer powders with desirable metallurgical properties are formed using a metallic melt.

12 Claims, 4 Drawing Figures

THE VARIATION OF THE SOLUBILITY OF NITROGEN IN IRON UNDER A PRESSURE OF ONE ATMOSPHERE OF NITROGEN WITH TEMPERATURE (FROM DARKEN AND GURRY, "PHYSICAL CHEMISTRY OF METALS", McGRAW-HILL, NEW YORK, 1953).

THE VARIATION OF THE SOLUBILITY OF NITROGEN IN IRON UNDER A PRESSURE OF ONE ATMOSPHERE OF NITROGEN WITH TEMPERATURE (FROM DARKEN AND GURRY, "PHYSICAL CHEMISTRY OF METALS", McGRAW-HILL, NEW YORK, 1953).

TANDEM ATOMIZATION METHOD FOR ULTRA-FINE METAL POWDER

TECHNICAL FIELD

The present invention relates to methods and equipment for producing ultra-fine, rapidly solidified powders directly from a melt, and uses a soluble gas/subsonic, supersonic, or ultrasonic gas atomization technique.

BACKGROUND OF THE INVENTION

Several commercial techniques for producing fine, rapidly solidified metal powders are well described and characterized in the technical literature. These include sonic and ultrasonic gas atomization, rotating electrode, and rotating cup/dish techniques which produce various metal powders with an average particle size generally in excess of 10 micrometers (μm). In each of these processes, liquid metal is atomized and rapidly solidified at cooling rates in excess of 10 °K/s and up to $10^6$ °K/s. The fine powders so generated can consist of meta-stable metallurgical phases and, either singularly or when compacted, can exhibit unique mechanical, electrical, magnetic, and chemical properties. Commercial applications of rapidly solidified and other fine metal powders include the use of:

a. aluminum powders as a solid rocket fuel,
b. superalloy powders for high performance turbine engine blades,
c. copper and precious metal powders with viscous fluids to form electrically conductive pastes, and
d. iron powder as a reprographic carrier and magnetic recording medium.

This list is intended to provide a range of examples of commercial applications of fine metal powders and is not meant to be exhaustive. The availability of rapidly solidified fine metal powders in large quantities with a particle size of less than 10 μm would enhance current applications as well as also generate new commercial applications.

SUMMARY OF INVENTION

The present invention provides both a device and method for generating rapidly solidified metal powders with an average particle size significantly less than 10 μm directly from a melt. In a preferred embodiment, the invention includes a gas atomization die having an orifice through which the liquid metal passes to create a rapidly solidified, ultra-fine powder. This die may rely solely on heat conducted from the molten metal or heat provided by an internal heater to maintain the temperature of the orifice at a level sufficient to avoid melt freeze-off during operation. The molten metal to be atomized is made to contain soluble species, such as hydrogen, nitrogen, or carbon and oxygen in carbon steel, which will either leave solution independently or combine to form gaseous products which leave solution as the metal cools. The rapid generation of this gas phase within the fine metal droplets as they rapidly cool upon exiting the gas atomization die causes the gas atomized metal droplets to further disintegrate into an ultra-fine powder with an average particle size significantly less than 10 μm. This soluble gas atomization-/impinging gas atomization technique is iniquely capable of generating rapidly solidified metal powders with an average particle size in the submicron range.

BRIEF DESCRIPTION OF DRAWINGS

These and other objects and features of the invention will be more readily understood by consideration of the following detailed description given with the accompanying drawings.

DESCRIPTION OF THE SPECIFIC EMBODIMENTS

The preferred embodiments of this invention are described in the context of producing quantities of rapidly solidified, ultra-fine metal and alloy powders. This invention is equally applicable to the atomization of any liquid melt from which a fine solid powder or aerosol can be generated. This includes but is not restricted to iron and steel, superalloys, aluminum, copper, precious metals, and associated alloy systems. (The term "melt", as used in this description and the following claims, will be understood to include any liquid suitable for atomization in accordance with the present invention.) Item numbers are uniform throughout the description of the device.

Figure 1:
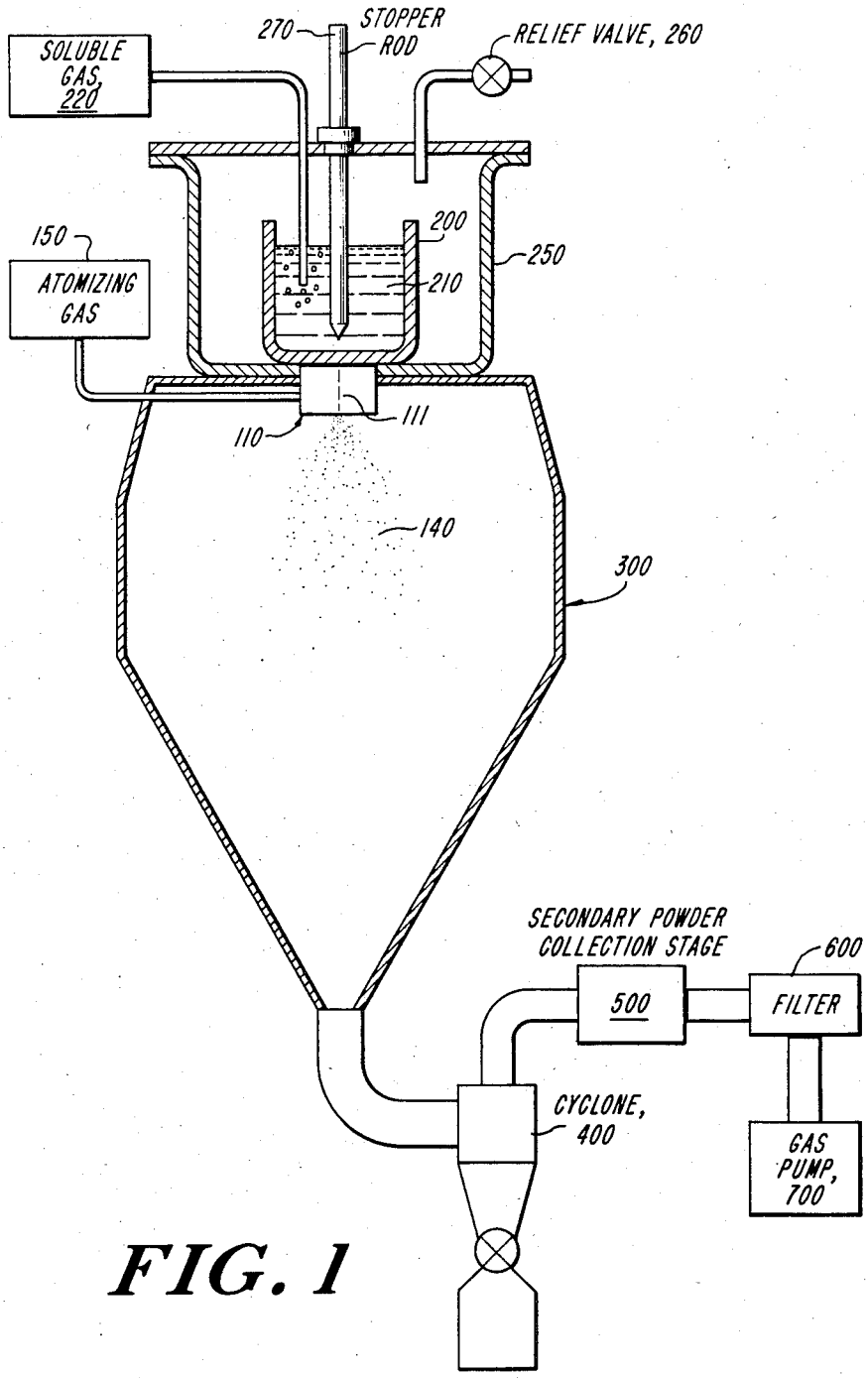
FIG. 1 is a schematic overview of the ultra-fine powder generation facility consisting of the melt containment vessel, gas atomization device, rapid cooling chamber, and powder collection and recovery system.

Referring now to FIG. 1, a perspective view is shown of the atomization system, consisting of the gas atomization device 100, crucible or furnace melt containment vessel 200, and fine powder collection system. The latter consists of a rapid cooling chamber 300, cyclone separator 400, second stage fine powder removal device 500, ultra-fine powder filter 600, and gas pump 700.

Figure 2:
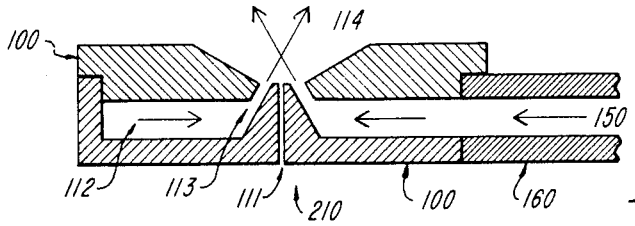
FIG. 2 is a detailed view of a preferred embodiment of the invention showing the main features of the gas atomization die.
Figure 4:
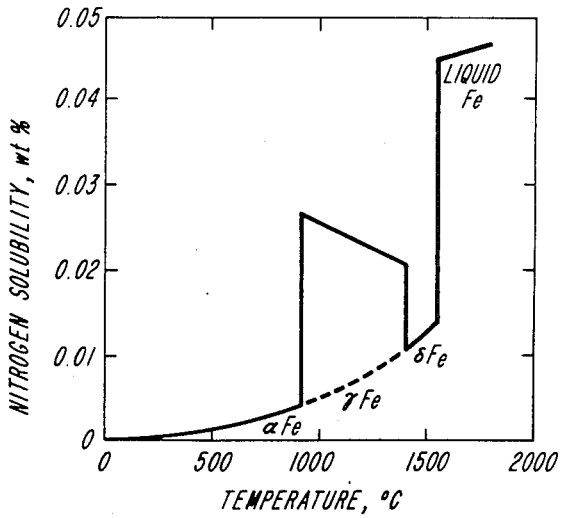
FIG. 4 illustrates the temperature dependence of the solubility of gas in metal, in this case nitrogen in iron.

Gas atomization dies, per se, are known in the art and consist of an orifice through which the melt passes, and one or more high pressure gas jets for breaking up and atomizing the melt as it passes out of the die orifice. The gas atomization die 100 can be of subsonic, supersonic, or ultrasonic design. A subsonic gas atomization device is illustrated here in FIG. 1. Ultra-fine metal powder 140 is produced by passing pressurized gas 150, such as argon, nitrogen, etc., through the atomization die 100. This atomization gas 150 is delivered to the atomization die 100 via a gas delivery passage 160 through the body of the die 100. This high pressure gas 150 exits the atomization die 100 at high velocity, thereby aspirating the melt 210 through the atomization die orifice 111. When aspirated (or forced) through the die 100, the molten metal 210 is atomized and rapidly cooled by the impinging, high velocity, atomization gas jet 114 (FIG. 2). During this very short rapid cooling and solidification period, the atomized droplets 140 are further disintegrated into ultra-fine powders by the rapid generation of gas within the droplets. This gas, which "explosively" disintegrates the already atomized droplets, is soluble in the liquid melt but its solubility is a strong function of temperature and, therefore, gas is rapidly generated within each droplet as it cools upon exiting the atomization die 100. The solubility of nitrogen in iron is illustrated in FIG. 4, by way of example. The solubility of nitrogen in iron is a function of temperature, and changes abruptly and significantly at specific temperatures where phase transitions occur. Referring to FIG. 4, one can expect significant soluble gas evolution either upon rapidly cooling of the melt and/or when structural phase changes occur in the melt at the specific transition temperatures. Consequently, the rate of soluble gas evolution and subsequent extent of soluble gas atomization is a function of the rate at which the melt is cooled.

In FIG. 1, the melt 210 to be atomized is located above the atomization die 100 and the rapid cooling chamber 300. In practice, the atomization die 100 could access the crucible or furnace 200 from the bottom, top, or side. It is also possible for the crucible 200 and atomization die 100 to be located entirely within the cooling chamber 300.

Before the atomization process begins, the melt 210 must be saturated with a soluble gas 220. If the crucible 200 is closed, the melt 210 can be supersaturated by holding the soluble gas 220 at elevated pressure above the melt 210. Various gases, including argon, nitrogen, and hydrogen, which are soluble in liquid metals, can be used. These soluble gases can be introduced into the melt 210 via a gas bubbling mechanism and/or can simply be held at static pressure over the melt 210 if the crucible 200 is closed. As the melt exits the gas atomization die 100 and begins to cool rapidly, the soluble gas comes out of solution within the atomized melt droplets, expands rapidly, and causes the metal to further disintegrate into ultra-fine powder.

It is known in the art of soluble gas atomization that a melt can be supersaturated with soluble gas by pressurizing the melt containment vessel with the gas to be dissolved. In such systems, the head pressure is used to propel the melt material through a transport tube into an evacuated chamber. The gas is evolved from the melt as it exits the transport tube into the evacuated chamber due to the low partial pressure of the soluble gas surrounding the melt stream in the evacuated chamber. In such cases, the dissolved gas expands within the melt as it leaves the transport tube causing it to be atomized. The abrupt change in the over-pressure of the soluble gas causes the gas to be evolved from the melt and atomizing it. In expanding, the gas cools thus cooling the melt. This cooling rate is low, typically 10 to $10^2$ °K/s.

In the present invention however, the melt containing soluble gas is atomized and rapidly cooled by the gas atomization process. The melt is atomized into a chamber 300 which need not be evacuated. Because the melt is rapidly convectively cooled by the impinging gas atomization jet, the evolution of soluble gas from the melt is driven predominantly by the temperature change of the atomized droplets. Soluble gas will be evolved in especially significant quantities at phase change temperatures such as correspond to the solidus-liquidus line.

This unique combination of the gas atomization and temperature versus pressure driven soluble gas atomization processes, which generates ultra-fine powders, is the essence of this invention. For example, when this device and method is applied to carbon steel, ultra-fine powder with an average particle size of less than 1 μm is generated. This ultra-fine carbon steel powder is an order of magnitude smaller than the smallest metal powder (greater than 10 μm) produced by any other commercially viable technique.

The melt 210 may contain soluble gases 220 and/or elemental components which will combine, on cooling of the melt 210, to generate a gas. One example of this latter case is carbon and dissolved oxygen in carbon steel. Upon cooling, the carbon reacts with the dissolved oxygen to form carbon monoxide gas. Since carbon monoxide only has a negligible solubility in solid carbon steel, it is rapidly evolved upon cooling and solidification and can generate tremendous internal gas pressures if trapped within the solid steel. Hence, this type of gas generation upon cooling of the melt is very desirable in the present invention. This phenomena of carbon monoxide generation during cooling or solidification of carbon steel is well known in steelmaking. It is generally avoided by "killing" the melt with aluminum which reacts with the oxygen to form solid aluminum oxide particulates.

A soluble gas may also be generated within the melt 210 by introducing a specific constituent which reacts in the melt 210 to generate a soluble gas. One example of this method is steam, which, when bubbled through carbon steel, reacts to form soluble hydrogen and oxygen. As the melt cools, the oxygen is available to combine with carbon present in the steel to form insoluble carbon monoxide gas. In addition, the hydrogen will also leave solution upon cooling of the melt and contribute to the soluble gas atomization component of the current atomization invention. A further example would be the addition of methane to carbon steel, for example. Here the methane reacts to form soluble carbon and hydrogen in the melt.

FIG. 1 also illustrates the powder collection system. This consists of a rapid cooling chamber 300 within which the ultra-fine powders 140 are generated and rapidly cooled by the impinging atomization gas jet. This cooling chamber 300 can be designed to accommodate multiple atomization dies. The cooling chamber's dimensions are such so as to allow the powders 140 to solidify and cool sufficiently before passing to the cyclone separator 400. The atomized powders are carried by the atomization gases, or pneumatically transported, from the cooling chamber 300 to the cyclone separator 400. Powders in the micron size range and larger are removed from the transport gas by the cyclone separator 400. A parallel series of cyclone separators could be used to selectively separate the powder 140 by average particle size.

Ultra-fine powder 140 in the submicron particle size range will pass through the cyclone separator 400 with the carrier gas to the second stage powder recovery unit 500. This unit may consist of a magnetic, electrostatic, impact, or solution separator. Any powder failing to be removed by the second stage powder recovery unit 500 will pass on to a filter 600 in the gas transfer line. This fine grade filter 600 will remove all powder residue from the atomization gas 150 before it passes on through the gas pump 700 and out of the sytstem.

FIG. 2 illustrates one specific subsonic gas atomiation die 100 design used in this invention. High pressure inert gas 150 is supplied to the atomization die 100 via a conduit 160. The inert gas 150 fills the annular core 112 of the atomization die 100 and passes at high velocity into the rapid cooling chamber 300 via an inclined annular gas nozzle 113 which circumscribes the top of the atomization die orifice 111. The passage of the high velocity inert gas 150 over the top of the atomization die orifice 111 reduces the pressure within the orifice passage 111, assisting liquid metal 210 to pass through the orifice 111. The liquid metal 210 is also aspirated through the orifice 111 with the assistance of the head pressure of the liquid metal bath 210. As the aspirated liquid metal exits the orifice 111 and enters the cooling chamber 300, it is atomized by the combined effect of the impinging gas jet 114 and the "explosive" soluble gas atomization effect created by the gas evolved during the rapid cooling of the melt 210. The atomized liquid metal 140 is rapidly solidified by this high velocity, expanding gas jet 114. The inclination angle of the impinging gas jet can be modified from one liquid metal to another to optimize the aspiration effect on the liquid melt 210 and the subsequent atomization of the liquid metal jet. The atomization gas 150 serves to carry the finely atomized powder creating a metal aerosol 140 which flows out of the cooling chamber 300 and on into the powder recovery cyclone 400 and second stage recovery unit 500.

Figure 3:
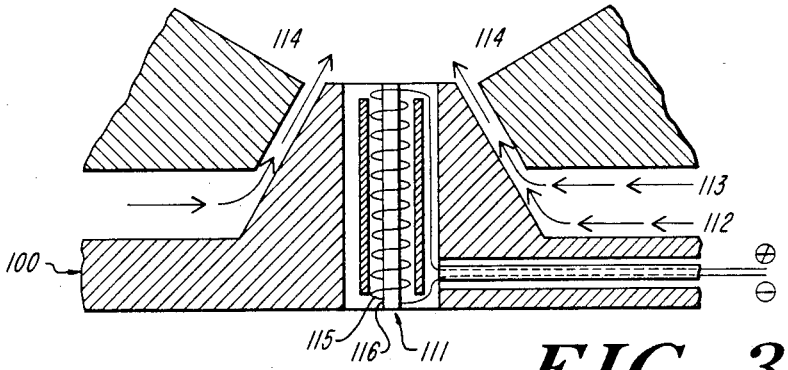
FIG. 3 is a detailed view of another preferred embodiment of the invention which illustrates the gas atomization die equipped with an orifice heating element to eliminate freeze-off during operation.

FIG. 3 illustrates a further embodiment of the atomization die 100. In this embodiment, the gas atomization die 100 is fitted with an orifice heating element 115 which eliminates any orifice freeze-off problem. The heating element consists of a simple metal coil 115 which is wrapped around the central orifice sleeve 116. The particular metallic heating element selected is determined by the operating temperature requirements of the melt to be atomized. For example, the atomization die 100 for a tin melt can be maintained from the melting point of tin with a nichrome heater element, whereas for a ferrous system a tungsten or molybdenum filament may be suitable. The heat generated by the heating coil 115 serves to insulate the central orifice sleeve 116 from the cooling effect of the inert gas passing through the annular nozzle 113 of the die 100. The heating coil 115 may be connected to a heat control device so as to provide only enough heat to ensure that the melt being atomized remains above its melting temperature as it passes through the orifice 111, or to control the rate or extent of metal build-up within the orifice 111.

FIGS. 2 and 3 show details of a subsonic gas atomization die 100 which may be used in the initial atomization/cooling step of the present invention. This die design may be used with a range of orifice 111 and annular nozzle 113 sizes. In an earlier patent application described in U.S. patent application Ser. No. 522,913, filed Aug. 12, 1983, this design incorporates an orifice 111 as small as a fraction of millimeter (mm). In this invention, the refractory die 100 illustrated in FIG. 2 has been used to demonstrate the unique gas atomization/soluble gas atomization process with a carbon steel melt 210 using a 0.75 mm orifice 111. However, the orifice 111 could be enlarged considerably, with the die 100 retaining its ultra-fine powder generation capability as long as an appropriate atomization gas flow to melt flow ratio of at least approximately 10 to 1 is maintained. The use of an enlarged die orifice 111 facilitates the production of commercial quantities of the ultra-fine powders.

The soluble gas/gas atomization process, according to the present invention, for generating ultra-fine, rapidly solidified powders is initiated by first introducing a soluble gas 220 into the melt 210, FIG. 1. As shown in this embodiment, the melt crucible or furnace 200 can be contained within a pressure vessel 250. The amount of soluble gas 220 in the melt 210 can be increased by maintaining the soluble gas at high pressure over the melt 210. A relief valve 260 is desirable to avoid building up excessive pressure within the vessel 250. After the melt has been saturated with soluble gas 220, the stopper rod 270, which restricts melt flow to the atomization die 100, is withdrawn. Simultaneously, high pressure atomization gas 150 is supplied to the atomization die 100. The melt flow through the atomization die 100 is assisted by gravity, the head pressure within the containment vessel 250, and the aspiration effect of the atomization gas 150 through the die 100. As the melt 210 exits the die 100 it is atomized by the impinging gas jet 114, FIG. 2. This gas atomization process not only atomizes the metal exiting the die 100, but also conductively cools the atomized droplets as well. Consequently, the soluble gas within the melt comes out of solution rapidly, expands, and further disintegrates the atomized droplets into ultra-fine powder 140. The atomized ultra-fine powder 140 in the cooling chamber 300 is carried by the gas used in the atomization process. This fine powder aerosol 140 exits the cooling chamber and enters the cyclone separator 400 where all powder particles larger than roughly a micron in diameter are removed. The submicron powder is transported by the gas flow from the cyclone 400 to the secondary powder collection device 500. This unit may consist of a magnetic, electrostatic, fluid, or other fine particle separator. Residual powders are removed from the carrier gas by an in-line fine particle filter 600. The gas pump 700 aids in initiating the gas flow from the cooling chamber 300 and on through the powder removal and collection system.

It will be appreciated that while the invention has been described in terms borrowed from the soluble gas atomization and from the gas atomization of conventional techniques, the invention involves ultra-fine atomization by driving soluble gas from an atomizing melt through cooling, and, as such, includes within its scope a variety of techniques and devices for achieving this result as limited only by the following claims.

What is claimed is:

1. A method of producing an ultra-fine powder from a melt material, such method comprising:

dissolving in the melt a gas having a great difference in solubility between the liquid and the solid phases of the material;

atomizing the melt by means independent of the gas dissolved in the melt to produce atomized material; and cooling the atomized material so that the dissolved gas is abruptly and voluminously released from solution, further disintegrating the atomized material to an ultra-fine powder.

2. A method according to claim 1, wherein the gas is one having a solubility curve with an approximately asymptotic segment at a temperature between the liquid and solid phases of the melt.

3. A method according to claim 1, wherein the melt is a metallic melt.

4. A method according to claim 3, wherein the melt is partially unkilled carbon steel, and the gas is carbon monoxide formed by the reactive carbon and oxygen dissolved therein.

5. A method according to claim 1, wherein the step of dissolving includes the step of introducing one or more reactive constituents in the melt for generating such gas in the melt.

6. A method according to claim 1, 2, 3, 4, or 5, wherein the step of atomizing and rapidly cooling the melt includes the step of atomizing the melt by gas atomization.

7. A method of forming ultra-fine powder from a melt material, such method including the steps of:

introducing into the melt a soluble gas capable of being released in voluminous quantity upon cooling of the melt; and atomizing and cooling the melt with a gas atomization device, so that release of the soluble gas during atomization results in the further disintegration of the atomized material so as to form ultra-fine powder.

8. A method according to claim 7, wherein the gas is one having a solubility curve with an approximately asymptotic segment at a temperature between the liquid and solid phases of the melt.

9. A method according to claim 7, wherein the melt is a metallic melt.

10. A method according to claim 9, wherein the melt is partially unkilled carbon steel and the gas is carbon monoxide formed by the reactive carbon and oxygen dissolved therein.

11. A method according to claim 7, wherein the step of introducing includes the step of introducing one or more reactive constituents in the melt for generating such gas in the melt.

12. A method of producing an ultra-fine powder from a melt material, such method comprising:

dissolving a gas in the melt having a great difference in solubility between the liquid and solid phases of the material;

creating a stream of the melt material by means independent of the gas dissolved in the melt; and cooling the stream, so that the dissolved gas is abruptly and voluminously released from solution.

* * * * *